United States Patent [19]

Labude et al.

[11] 4,431,876

[45] Feb. 14, 1984

[54] KEY SWITCH

[75] Inventors: Wolfgang Labude, Constance; Karl-Heinz Bauer; Edgar Maisch, both of Bad Neustadt, all of Fed. Rep. of Germany

[73] Assignee: Preh Elektrofeinmechanische Werke Jakob Preh Nachf. GmbH & Co., Bad Neustadt, Fed. Rep. of Germany

[21] Appl. No.: 263,692

[22] Filed: May 14, 1981

[30] Foreign Application Priority Data

May 16, 1980 [DE] Fed. Rep. of Germany ..... 3018810

[51] Int. Cl.[3] ..... H01H 9/00; H01H 13/00

[52] U.S. Cl. ..... 200/5 R; 200/6 B; 200/6 C

[58] Field of Search ..... 200/5 R, 5 A, 5 E, 6 C, 200/159 A, 67 D, 67 DA, 67 DB, 76, 6 B

[56] References Cited

U.S. PATENT DOCUMENTS

| | | | |
|---|---|---|---|
| 3,675,504 | 7/1972 | Schuh | 200/5 E X |
| 3,792,387 | 2/1974 | Arrington et al. | 334/7 |
| 4,035,596 | 7/1977 | Marquardt et al. | 200/76 |
| 4,177,367 | 12/1979 | Tirone et al. | 200/67 DA X |

FOREIGN PATENT DOCUMENTS

| | | |
|---|---|---|
| 1489625 | 8/1969 | Fed. Rep. of Germany . |
| 1919036 | 11/1971 | Fed. Rep. of Germany . |
| 1791232 | 12/1971 | Fed. Rep. of Germany . |
| 2302699 | 7/1973 | Fed. Rep. of Germany . |
| 2360168 | 6/1975 | Fed. Rep. of Germany . |
| 2264953 | 7/1977 | Fed. Rep. of Germany . |
| 2833184 | 2/1980 | Fed. Rep. of Germany . |

*Primary Examiner*—J. R. Scott

*Attorney, Agent, or Firm*—Woodcock, Washburn, Kurtz, Mackiewicz & Norris

[57] ABSTRACT

A key switch comprises a casing, at least one key slide guided in the casing against the force of a spring and at least one J-shaped leaf spring having a long spring arm and a short spring arm connected to the long arm by a curved intermediate part, the leaf spring being clamped to assume a unilateral curvature between two abutments, one fixed and the other moveable, the leaf spring having the free end of its long spring arm supported in a first abutment in the key slide and its curved intermediate part in a second abutment formed in a fixed contact member provided in the casing. For providing a minimum space the leaf spring is mounted parallel to the sliding direction in an elongated recess of the key slide.

20 Claims, 6 Drawing Figures

KEY SWITCH

BACKGROUND OF THE INVENTION

1. Field of the Invention

The invention relates to a key switch comprising a casing, at least one key slide guided in the casing against the force of a spring and at least one J-shaped leaf spring having a long spring arm and a short spring arm connected to the long arm by a curved intermediate part, said leaf spring being clamped to assume a unilateral curvature between two abutments, one of which is movable relative to the other, and having the free end of its long spring arm supported in a first abutment in the key slide and its curved intermediate part in a second abutment of a fixed contact member provided in the casing.

2. Brief Description of the Prior Art

Key switches of this kind in multiple unit arrays are required, for instance, for key assemblies for switching in the individual channels of high frequency receivers, such as radio and television receivers. By means of a single key-pressing operation the respective preset tuning voltage and thus the associated station or channel, can be switched in. Storage of the set tuning voltage takes place in the channel memory in the form of spindle-type resistors or variable resistors connected as voltage dividers.

A key switch in connection with a key assembly is already known, wherein the key switch consists of a narrow elongated switching rod guided in the front and rear walls of the casing. The switching rod has a plurality of integrally formed shoulders on its underside. On the bottom of the casing contact bars are mounted tranversely to the switching rods, which among other elements comprise a connecting member and a number of U-shaped spring elements corresponding to the number of switching rods. One end of each spring element is fastened to the connecting member, whereas the free end cooperates with the shoulders of the switching rod.

When any one of the switching rods is pressed, the free end of the spring element is urged against the respective associated wire contact by means of the shoulders. The spring elements accordingly serve simultaneously as return springs for the switching rods and as electrical connectors. The spring elements are subject to bending as well as torsional stress in the closed circuit condition.

Furthermore, a key switch is already known, wherein a push rod is adapted to slide against the force of a return spring. The snap spring and the contact arm are formed integrally and are of J-shaped configuration. With its curved intermediate part the spring is pivotally supported in a fixed contact member. The free end of the long spring arm is supported in a knife-edge bearing of the push rod. The long spring arm thus is clamped between two abutments to define a unilateral curvature. The short spring arm serves as contact arm and carries a contact rivet. In one embodiment two snap springs are arranged on both sides of the push rod, and furthermore the push rod additionally comprises a supporting member mounted for sliding up and down in the sliding direction of the push rod. When the push rod is pressed down, the return spring is compressed and at the same time the two snap springs are pivoted and tensioned. As soon as the dead centre position is reached, the snap springs suddenly snap into the ON position, while the supporting member moves relative to the push rod. It is a condition for this switching mechanism that the snap springs be arranged symmetrically and almost perpendicularly to the sliding direction of the push rod. Because of this condition, very much space is occupied in the lateral direction.

SUMMARY OF THE INVENTION

It is an object of the present invention to provide a key switch which retains the advantage of the above type of switch, but having the improvement of a minimum overall width. This problem is solved in accordance with the invention in that the leaf spring is mounted parallel to the sliding direction in an elongated recess of the key slide.

Further advantageous developments of the invention are set forth in the detailed description and the specific limitations of the claims.

BRIEF DESCRIPTION OF THE DRAWINGS

The invention is described more specifically hereinafter with reference to a preferred embodiment shown in the following drawings.

DETAILED DESCRIPTION OF THE PREFERRED EMBODIMENTS OF THE INVENTION

Figure 1:
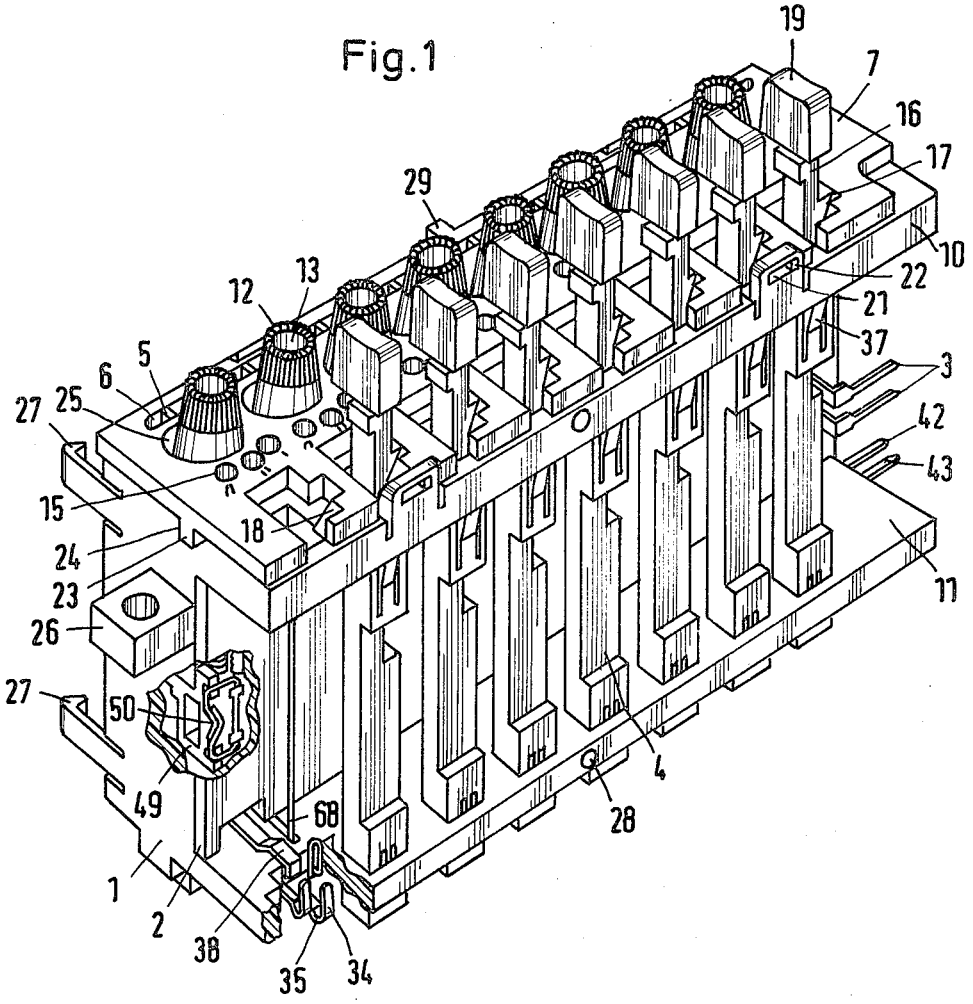
FIG. 1 is a perspective view of a key switch in connection with a key assembly.
Figure 2:
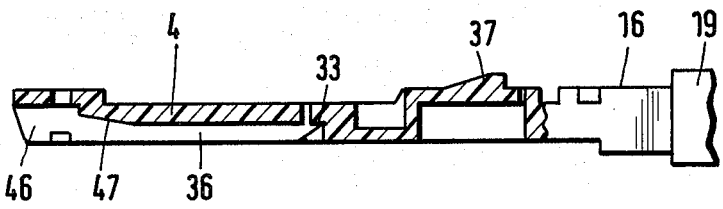
FIG. 2 is a sectional view of a key slide employed in a preferred embodiment of this invention.
Figure 6:
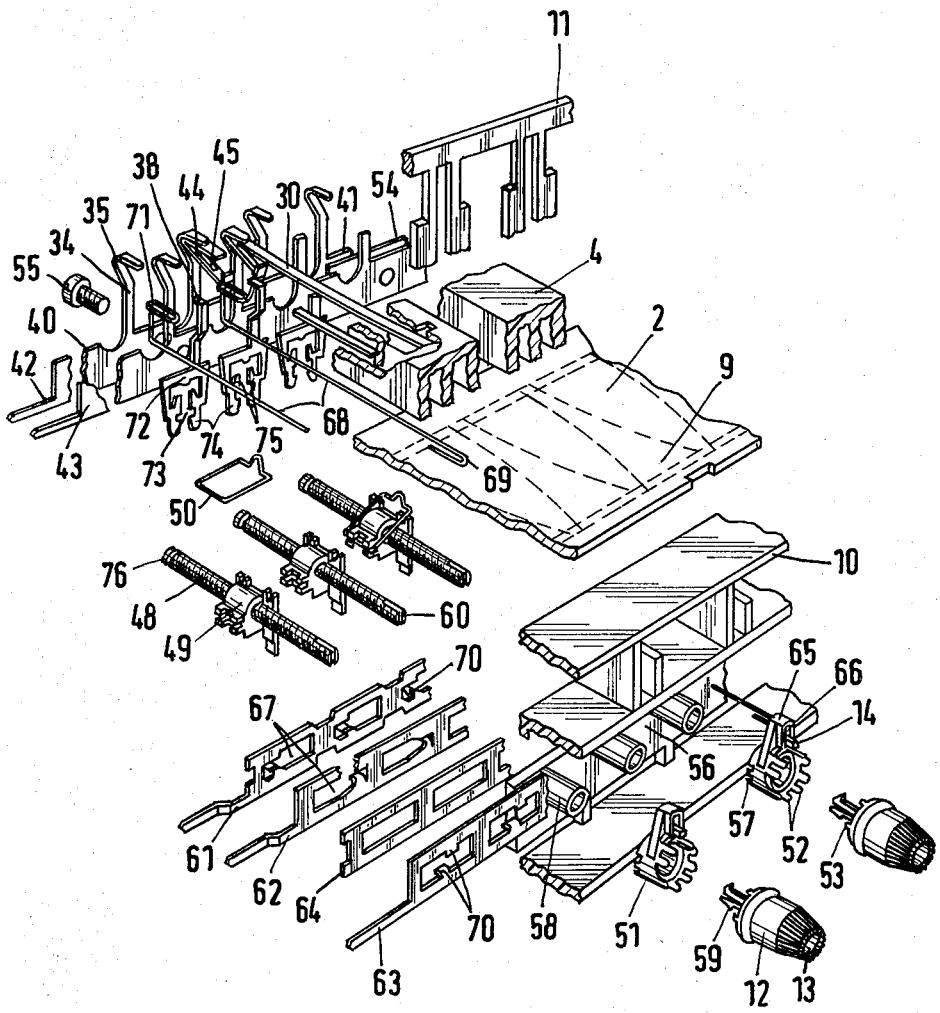
FIG. 6 is an exploded view of the key assembly of this invention, providing detail of the band switch means.

The key assembly shown in FIGS. 1 and 6 comprises eight keys which are designed, for example, for switching in the tuning voltages preset in respective individual channel memories of a multiple channel receiver. The channel memories consist of spindle-type resistors, in which a spring support 49 provided with a sliding contact element 50 is guided along a spindle 48. The sliding contact element 50 establishes an electrical connection between a collector path or the spindle and a resistor element 9 (see FIG. 6) which is mounted in multiple unit array on an insulating plate of hard paper or plastic material. This insulating plate denoted by reference numeral 2 in FIG. 1 forms the closure of a casing 1 having one open side e.g., the bottom. As seen in FIG. 1, portion 10 of the casing forms the front wall, and portion 11 forms the rear wall. For reasons of stability and consequently accuracy of recurrence or repeatability, the casing is made of glass fibre-reinforced plastic material. As can be seen from FIG. 1, the soldering lugs 3 of the resistor elements project laterally from the rear end of the casing.

On one of its ends each spindle is provided with a rotary push-button 12 having a grooved edge or an edge portion to which gripping capacity has otherwise been imparted, whereby the rotary push-button can be turned directly. However, the rotary push-button may also be turned with the aid of a socket key not shown in FIG. 1. To this end the rotary push-button is provided with a cavity 13 having a specific inner contour. For tuning, the socket key is inserted into this cavity, said socket key having an outer contour mating the inner contour to provide operative engagement. Between the rotary push-button and the casing a coupling element 51, shown in FIG. 6, is provided for frequency range change-over. This coupling element is made of plastic material. The frequency range change-over system, or the band switch system, can be seen more clearly from the exploded view of FIG. 6. The coupling element 51 has a spring collar 52 on its circumference, which cooperates with an opposed chamfer on the outer face of the rotary push-button 12. Furthermore, the rotary push-button has axially parallel toothing at the end of the chamfer, the teeth 53 of which are arranged cross-wise. In the pressed condition the teeth 53 project into a corresponding inner profile of the coupling element 51 and function in the manner of a dog coupling mechanism. By pressing the rotary push-button, the coupling element 51 is urged against the wall of the casing. This wall comprises two integrally formed diametrically opposite projecting nipples 56, which engage notches 57 of the coupling element 51 and bring about step-wise locking in conformance with the number of frequency ranges. To insure better guidance of the rotary push-button 12, said push-button is guided along a sleeve 58 formed integrally with the casing and telescoping into the rotary push-button 12.

To insure that the spindle 48 as well rotates when the rotary push-button is turned, the rotary push-button comprises integrally formed snap tongues 59 extending through the coupling element into a longitudinal recess 60 of the spindle. The coupling element 51 furthermore is provided with an integrally formed pointer 14, which is visible in one of the three segmentally arranged display windows 15 of the locking plate 7, depending on the respective locking position. The coupling element 51 is provided with a lateral swivel projection 65 formed integrally therewith, which has a central throughhole 66. A resilient loop 69 of a wire contact spring 68 extends through this hole. As will be described in further detail hereinafter, this contact spring serves to perform the frequency range change-over or band switching, respectively. When the coupling element is turned into one of its locking positions, this contact spring 68 as well is pivoted correspondingly over a small angular range.

Between each of the coupling elements and the casing a second and a third metal collector bar 62 and 63 respectively are also provided both being electrically insulated from each other by an insulating spacer 64. On the inside of the casing a first collector bar 61, likewise of metal, is provided. These collector bars are common to all keys and their number corresponds to the number of preselectable frequency ranges or bands, respectively. Each of these collector bars is provided with elongated openings 67 corresponding to the number of keys, on the longitudinal edges whereof contact elements 70 are oppositely bent off in pairs. These contact elements serve, on the one hand, as mounting supports on the casing and, on the other hand, as countercontact for the resilient loop 69 of the contact spring. As can be seen from FIG. 6, these contact elements are positioned either at the right end of the opening 67 or in the middle or at the left end, so that a total of three switch positions is possible.

Still referring to FIG. 1, guidance of the locking plate 7 on the front surface of the casing is effected in that the locking plate comprises detents 21 formed integrally with its longitudinal edges, which cooperate with locking elements 22 of the casing to accomplish locking. Furthermore the locking plate is provided on its underside with an integrally formed ridge 23 extending from the bottom side in the sliding direction. The ridge 23 is guided in a groove 24 of the casing. Since the detents project into the locking elements and the locking plate has to perform a sliding stroke, the locking elements 22 have the form of slots extending in the sliding direction, the length of which has to correspond at least to the length of the sliding stroke. The openings 25 in the locking plate, through which the rotary push-buttons 12 and the keys 16 extend, likewise have been extended by at least the length of the sliding stroke, i.e., the stroke of key slide 4 when it is pressed to the ON state.

The casing comprises a lateral attachment member 26 formed integrally with each of its side faces, with the aid of which the key assembly can be attached to the chassis of a television receiver.

As has already been mentioned initially, the key assembly shown in FIG. 1 is adapted to store up to eight channels. If even more channels are desired, a plurality of key assemblies can be combined in a modular system. To this end each modular unit is provided with four snap hooks 27 on one side of the casing, which engage openings not shown in FIG. 1 of the adjacent modular units. Furthermore, locking pins are provided for accurate positioning of the modular units with respect to one another, which are shaped to fit into holes 28 of the adjacent modular unit. Of course the keys are to be mutually releasable in this system as well. To this end each locking plate has a lateral carrier arm 29 on one of its longitudinal sides, which engages a suitably profiled recess of the adjacent locking plate and guarantees operative engagement free from play or lost motion.

The key 16 consists of a flat key slide 4, havng one of its ends guided in a guide means provided in a longitudinal rear wall 11 of the switch casing. The other end, which is guided in a longitudinal front wall, carries a push-button 19 on its face projecting from the casing. This push-button is press fit mounted on the key slide, or is formed integrally with the key slide directly by injection molding. By means of a detent 37 and a stop means not shown in FIG. 1 each key slide is supported in the casing and confined in its sliding direction.

Figure 4:
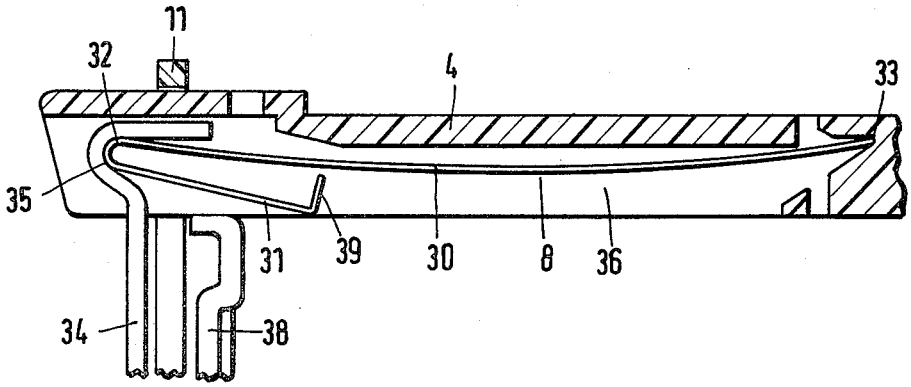
FIG. 4 shows the switch system in the OFF position.
Figure 5:
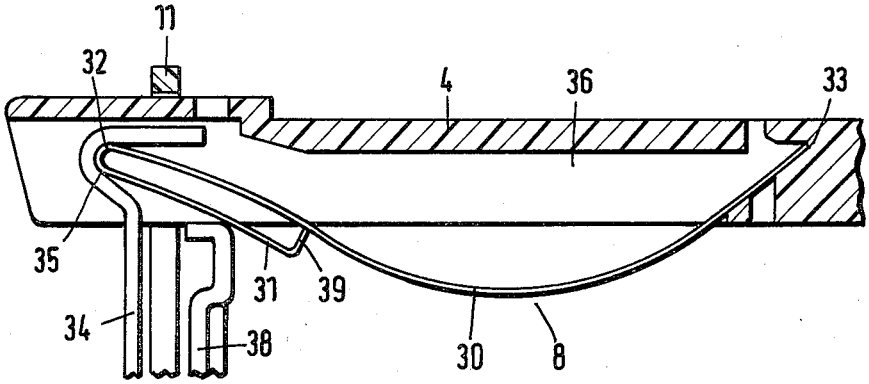
FIG. 5 shows the switch system in the ON position.

The key assembly shown in FIG. 1 is intended for use especially in television receivers. For this purpose it is necessary to perform frequency range change-over in addition to channel switch-in. Therefore two mutually independent contact systems are actuated by the key slide. For this reason two leaf springs 8 are mounted in the two elongated recesses 36 of each key slide. As can be seen from FIGS. 4 and 5, each leaf spring 8 has a J-shaped configuration and comprises a long spring arm 30 and a short spring arm 31, both being integrally connected to each other by a curved intermediate part 32. This leaf spring is clamped between two abutments 33, 35 so as to assume a slight lateral curvature. This is accomplished by arranging the two abutments in misalignment with each other. Due to the slight curvature of the leaf spring toward one side, it is guaranteed that the leaf spring always bulges further toward this side when the two abutments move relative to each other.

To lower the contact resistance, the leaf spring 8 itself may be made either completely of silver or of a cheap material provided with a silver coating, or another satisfactorily conductive contact layer at least on its contacting surface. The leaf spring performs a double function, being a contact spring, on the one hand, and a return spring for the key on the other hand. The long spring arm 30 substantially assumes the function of the return spring, whereas the short spring arm 31 serves as the contact arm. On account of this specific U-shaped configuration of the leaf spring, the key is very easily operable since, on pressing the key, substantially only the buckling load of the already bulged, relatively soft, long spring arm must be overcome. The contact pressure exerted by the short spring arm against the fixed contact member is added to the load of the long spring arm, but this contact pressure is reduced proportionally to the spacing of the engaging points. The contact pressure is increased by the bent portion of the short spring arm, being approximately perpendicular to the sliding direction of the key.

Figure 3:
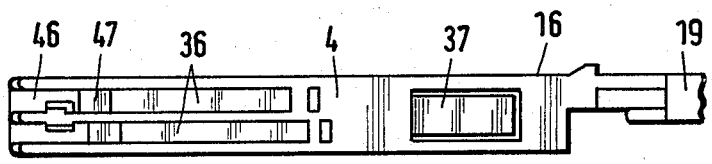
FIG. 3 is a bottom view of the key slide.

The first abutment 33 is provided in the key slide 4 at the recess end toward the push-button 19. The second abutment is formed by a V-shaped knife-edge bearing 35 in a first fixed contact member 34. This contact member simultaneously is a spring element, made of metal. Several spring elements are interconnected by means of a connecting member 41 (seen in FIG. 6) and constitute a first contact bar 40, the soldering pin 42 of which extends laterally from the casing. As can be seen from FIG. 6, this first contact bar 40 is attached to the longitudinal rear wall 11 of the casing. A second contact bar 43 provided with the soldering pin 44 likewise is mounted on this longitudinal rear wall, the latter contact bar serving for channel switch-in, whereas the first contact bar is used for switching through the frequency range selection. Both contact bars are fastened to the longitudinal wall by means of screws 55 such as to be electrically insulated from one another by means of an insulating plate 54. Furthermore, they are laterally staggered with respect to each other. The spring elements of the first and second contact bars form pairs and are arranged such as to be in alignment with the two recesses 36 in the key switch. Since, on the one hand, the spring elements associated in pairs are arranged in tandem and, on the other hand, the leaf springs are of equal length, the recesses in the key slide are of different lengths, as seen in FIG. 3.

One end of the long spring arm is supported in the first abutment of the key slide. With its curved intermediate part 32 the leaf spring 8 is supported in the V-shaped knife-edge bearing 35 of spring element 34 of contact bar 40. The short spring arm 31 has a bent portion at its free end, directed toward the long spring arm 30. As can be seen from FIG. 5, the long spring arm urges the short spring arm against the second fixed contact member 38 by means of the bent portion. Thereby the contact pressure is increased substantially. The first spring arm thus serves both as return spring for the key slide and as aid for the short spring arm which establishes an electrical connection between the contact bar 40 and the second fixed contact member 38 in the ON position, i.e., when the slide is pushed down. To provide the required switching functions, i.e. channel switch-in and frequency range selection, two types of second fixed contact members are present. For effecting channel switch-in, this contact member is an integrally formed metal part, comprising an upper portion 38 cooperating with the short spring arm 31 of the leaf spring, as can be seen from FIGS. 4 and 5, and a lower portion functioning as contact member 72 serving to contact the spindle 48. To this end, the lower portion has a central opening 73 extending from the bottom to the top thereof, which is intended to receive the spindle therein. From both sides two fork arms extend into this opening, the lower ends 74 of which are provided with detents engaging corresponding locking recesses in the casing. The upper, inwardly directed spring tongues 75 of said portion are in biased engagement with a groove 76 of the spindle.

The second fixed contact member for effecting frequency range change-over consists of a loop 71 of the contact spring, having a bent end.

What is claimed is:

1. Key switch apparatus for providing at least one switchable connection, comprising a casing, at least one key slide, said casing having guide means for guiding said key slide to permit it to be moved in a sliding direction along its length, said key slide having an elongated recess, at least one J-shaped leaf spring contact mounted in said recess for providing a force against movement of said slide, said leaf spring having a long spring arm with a free end and a short spring arm interconnected by a curved intermediate part, said slide having a first abutment, a first fixed contact member shaped to provide a second abutment and positioned so that said second abutment is in said recess, said leaf spring contact being positioned with its free end against said first abutment and said curved intermediate part against said second abutment so as to normally assume a unilateral curvature between said two abutments, a second fixed contact member positioned adjacent said recess so that said leaf spring contact does not contact it when in its normal position, said leaf spring contact being mounted in said elongated recess parallel to said sliding direction, whereby when said key slide is moved toward said first fixed contact member said first abutment is moved relative to said second abutment so as to increase said curvature and cause said short spring arm to contact said second fixed contact member, providing an electrical connection between said first and second contact member.

2. The key switch according to claim 1, characterized in that the short spring arm (31) has a feathered configuration at least in the area of contact with the second fixed contact member (38, 71).

3. The key switch according to claim 1, characterized in that the long spring arm (30) also is the return spring for the key slide (4).

4. The key switch according to claim 1, characterized in that the recess (36) is open on one of its longitudinal sides so that in the ON position the more considerably deformed leaf spring (8) projects with the middle portion of its curvature from the recess.

5. The key switch according to claim 1, characterized in that the bottom of the recess (36) comprises a depression (46) towards the open end.

6. The key switch according to claim 5, characterized by said recess including a chamber (47) sloping towards said depression whereby a transition to said depression is provided.

7. The key switch apparatus according to claim 1, characterized in that in the normal position of said leaf spring it has a slight curvature toward one side, whereby said leaf spring is forced further toward such side when said key slide is moved toward said first fixed contact member.

8. The key switch apparatus according to claim 1, characterized in that said key slide has a flat slide having one end to guide it in said guide means, and a push button on its other end.

9. The key switch apparatus according to claim 1, wherein said casing has a detent formed integrally therewith, and characterized in that said key slide has snap means for snap-engaging said casing detent.

10. The key switch apparatus according to claim 1, comprising a plurality of key switches, each having a key slide, J-shaped leaf spring and first and second contact members as described in claim 21, combined to form a key assembly, said plurality of key switches projecting from said casing.

11. The key switch apparatus according to claim 10, wherein said casing has means for mutually releasing said switches, thereby switching in storage, selectively adjustable electrical values of channel memories.

12. The key switch apparatus according to claim 1 or 10, characterized in that said apparatus comprises a contact bar having connected thereto a plurality of first fixed contact members corresponding respectively to a plurality of key switches.

13. The key switch according to claim 12, characterized in that two contact bars (40, 43) are provided, which are secured to the casing in electrically insulated and spaced relationship with each other, the spring elements (34) of the first contact bar (40) and the spring elements (34) of the second contact bar (43) each forming pairs and being laterally staggered with respect to one another such that the associated spring elements are aligned with the two recesses in the key slide.

14. The key switch apparatus according to claim 12, characterized in that said contact bar consists of a connecting member, a soldering pin extending from the casing and said first fixed contact members.

15. The key switch apparatus according to claim 1, characterized in that when said key slide is in the ON position, said short spring arm provides an electrical connection between said first and second fixed contact members.

16. The key switch apparatus according to claim 1, characterized in that said short spring arm has a free end with a bent portion oriented towards said long spring arm, against which said long spring arm presses when said slider is slid toward said first fixed contact member.

17. The key switch apparatus according to claim 1, characterized in that said leaf spring includes at least a silver coating.

18. The key switch apparatus according to claim 1, characterized in that said first abutment in said key slide is positioned at the end of said recess which is closer to said push button, and the opposite end of said recess is open.

19. The key switch according to claim 18, characterized in that the second abutment (35) consists of a V-shaped knife-edge bearing in the spring element (34).

20. Key switch apparatus for housing a plurality of manually operated keys positioned in an array, each of said keys being adapted to provide an electrical contact when manually moved, each said key comprising:

a key slide element adapted to be moved from a normal OFF position to an ON position, said key slide element having at least one longitudinal recess extending in its sliding direction and a leaf spring contact mounted in said recess, first and second fixed contact members, said first member having abutment means positioned in said recess for receiving one end of said leaf spring in an abutting relationship, said slide having second abutting means for receiving the other end of said leaf spring so as to normally hold said spring against said first member in a curved manner, said second member being positioned next to said first member and adjacent said recess so that when said slide is moved toward said first member said leaf spring curves out of said recess and contacts said second member, thereby providing an electrical connection between said first and second members.

* * * * *